United States Patent [19]

Swartz

[11] 3,988,991

[45] Nov. 2, 1976

[54] CONVEYOR SYSTEM UTILIZING SHIELDED READER UNITS

[75] Inventor: Horace M. Swartz, Doylestown, Pa.

[73] Assignee: FMC Corporation, San Jose, Calif.

[22] Filed: July 18, 1975

[21] Appl. No.: 597,260

Related U.S. Application Data

[63] Continuation of Ser. No. 327,976, Jan. 30, 1973, abandoned.

[52] U.S. Cl. ..... 104/88; 235/61.11 F; 246/2 S

[51] Int. Cl.[2] ..... B61J 3/04

[58] Field of Search ..... 104/88; 246/169 D, 2 S; 198/38; 214/11 R; 116/30; 235/61.11 F; 250/221

[56] References Cited

UNITED STATES PATENTS

| | | | |
|---|---|---|---|
| 3,117,754 | 1/1964 | Morganstern | 246/2 S |
| 3,174,439 | 3/1965 | Edgar et al. | 104/88 |
| 3,238,358 | 3/1966 | Read | 246/2 S |
| 3,304,412 | 2/1967 | Rabinow | 104/88 X |
| 3,316,392 | 4/1967 | Bailey et al. | 246/2 S |
| 3,526,192 | 9/1970 | Parshall | 104/88 |
| 3,532,059 | 10/1970 | Frantz | 104/88 |
| 3,559,584 | 2/1971 | Frantz et al. | 104/88 |

*Primary Examiner*—Stephen G. Kunin
*Assistant Examiner*—Barry L. Kelmachter
*Attorney, Agent, or Firm*—J. F. Verhoeven; C. E. Tripp

[57] ABSTRACT

A conveyor system in which code devices with reflectors mounted on trucks selectively coact with optoelectronic reader units to cause spur line switches to selectively divert the trucks from a main line to particular spur lines is disclosed. Each reader unit has an energy beam emitter and a beam sensor both covered by a barrier surface. The emitter casts a beam upwardly at an angle to the vertical through a cover opening so that the reflector of a particular code device will reflect the beam through the opening to the sensor which thereupon initiates actuation of a spur line switch.

5 Claims, 6 Drawing Figures

FIG_3
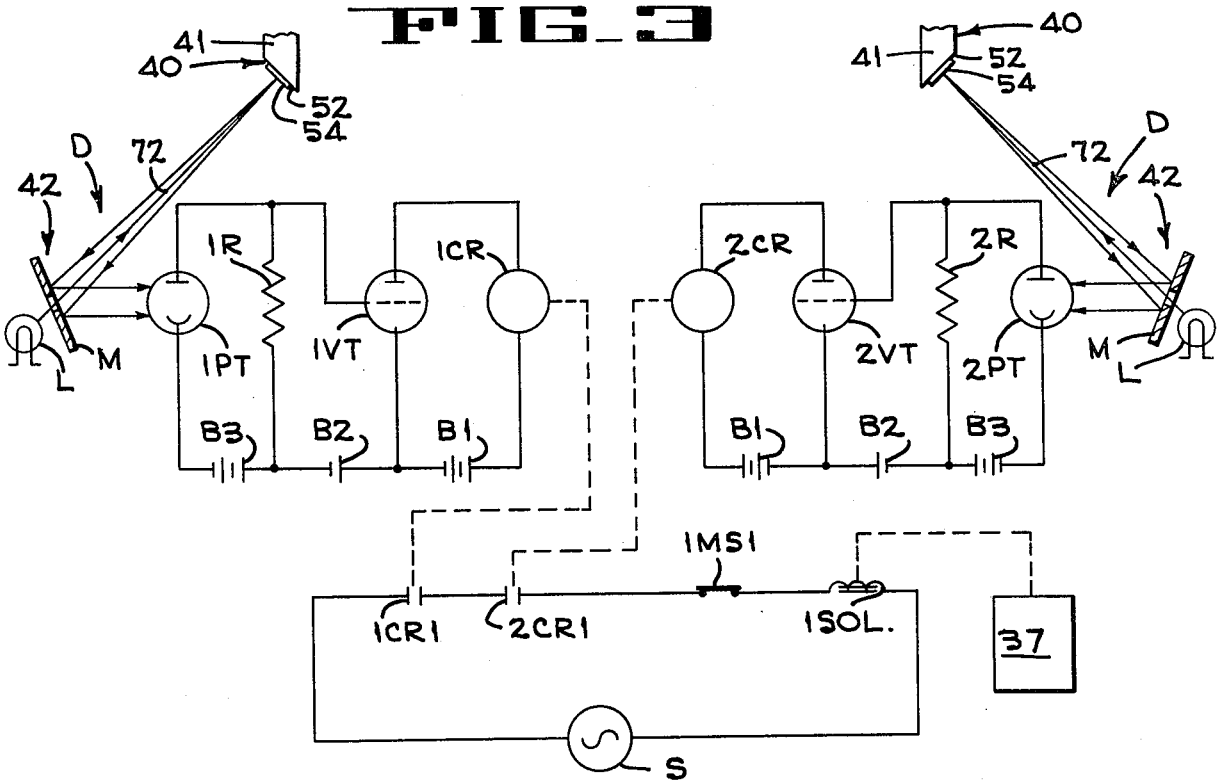
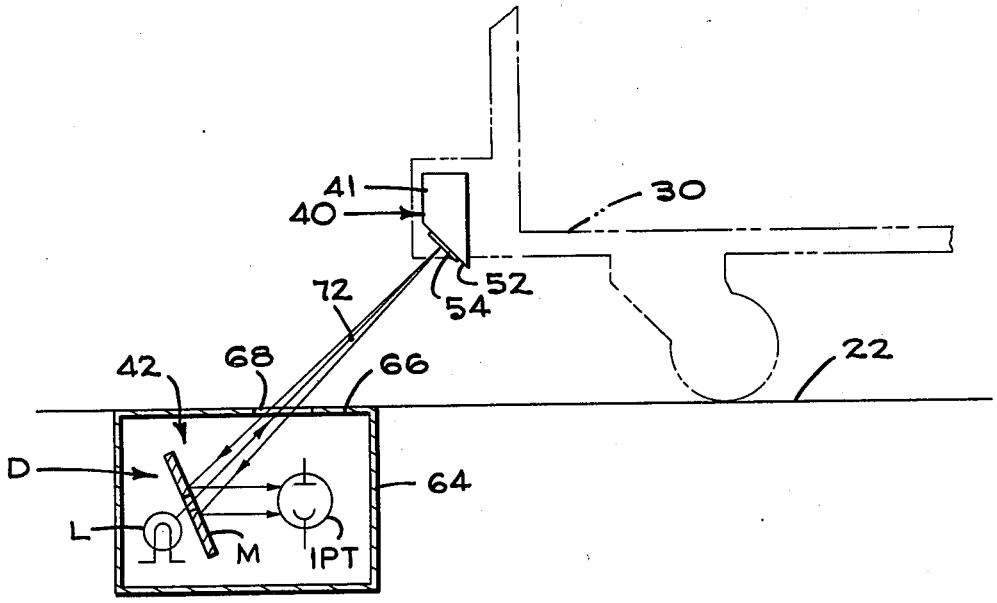
FIG_4

CONVEYOR SYSTEM UTILIZING SHIELDED READER UNITS

This is a continuation of application Ser. No. 327,976, filed Jan. 30, 1973, now abandoned.

BACKGROUND OF THE INVENTION

1. Field of the Invention

This invention relates to a conveyor system in which an optoelectronic reader unit having an energy beam emitter and beam sensor coacts with reflector means of a transport vehicle mounted code device to initiate operation of a spur line switch.

2. Description of the Prior Art

In the typical truck tow conveyor system, the truck transport vehicles move along a main line to spur line switches that can be operated to divert particular vehicles to respective spur lines. Each transport vehicle is provided with a suitable selectivity or coding device for selectively giving a signal to a particular optoelectronic reader unit coupled to a particular spur line switch so that selected vehicles can be diverted to a preselected spur line.

The U.S. Pat. application Ser. No. 301,025 of H. M. Swartz filed Oct. 26, 1972 (now abandoned) and the U.S. Pat. application Ser. No. 302,374 of C. A. Rosenburger, Jr., filed Oct. 30, 1972 (now U.S. Pat. No. 3,822,646 issued July 9, 1974), disclose truck tow conveyor systems employing coding systems for controlling the movement of transport vehicles or trucks along a main line and selected branch lines. The coding system shown in the application of H. M. Swartz is comprised of a coding device on each movable transport vehicle. Each device includes a code element positionable in any of a plurality of code positions and having a reflector means. Optoelectronic reader units, located in the vicinity of respective spur line switches, each employ a detector unit that has an energy beam emitter casting a vertically oriented energy beam upward through an opening in a cover in a floor into the path of the coding element of particular conveyor vehicles. Each detector unit also has a scanner or sensor device to receive reflected beam energy when the reflector means of a coding device on a vehicle intercepts the beam cast by the associated emitter to reflect the beam toward the sensor device. When the intensity of the reflected beam exceeds a predetermined threshold intensity, the sensor initiates operation of a spur line switch to divert the vehicle having the reflector means onto a spur line.

The reader units shown in the Swartz application include detector units that are located directly beneath an opening in the overlying cover in the floor and are oriented with their optical window elements facing upward. Dust, dirt and other matter may fall through the cover openings and deposit on the optical window elements of the detector units. Matter, such as debris, that gathers on a unit can cover the optical windows of its beam emitter and beam receiver to reduce the intensity of the beam impinging on the receiver or to actually obstruct the beam so that it can not impinge on the receiver. After a short or long period of time enough matter may gather on the optical windows to reduce the intensity of the beam impinging on the receiver (after reflection of the beam by a reflector means of a particular vehicle) to a level that is less than a threshold level which must be reached before resultant actuation of an associated spur line switch can be achieved. Thus, a vehicle carrying a properly positioned code element may approach a spur line switch bringing the code element into optical alignment with an associated reader unit and yet not be diverted by the switch to the associated spur line simply because the intensity of the reflected beam is below the threshold level.

SUMMARY OF THE INVENTION

The present invention provides an improvement in the coding systems shown in the aforesaid patent application of Swartz. The improvement provides barrier surface means above the optical windows of the energy beam emitter and beam sensor of the detector of each optoelectronic reader unit to keep dirt, dust, debris, loose material and other matter from falling onto the optical windows. In the preferred form of the invention, the beam emitter and beam sensor are both contained in the same detector unit, and this unit is oriented so that the beam emitter casts a beam upward at an angle to the vertical past the barrier surface means. Whenever the cast beam impinges on the reflector means of a code device on a conveyor vehicle the beam is reflected downward, at an angle to the vertical, past the barrier surface means onto the beam sensor which sensor thereupon operates the associated spur line switch. The barrier surface means may consist, as disclosed, of a cover plate set into a floor area over which the conveyor vehicles travel. This cover plate may have at least one opening, horizontally offset from the detector unit thereunder, through which a projected and reflected light beam may pass.

Accordingly, it is the main object of the invention to provide a conveyor system, having optoelectronic reader means for controlling the movement of transport vehicles, in which a beam emitter, and its optical window, is shielded by a barrier surface means, or cover, against deposits of matter thereon which might adversely affect the operation of the reader means. Another object of the present invention is to provide a barrier surface means for shielding a beam sensor of the reader means from dust, dirt, and debris and other matter. Yet another object of the present invention to mount the beam emitter and the beam sensor under a barrier surface means and to orient them so that the emitter projected beam and the sensed beam follow paths that are at an angle to the vertical and pass by the barrier surface means.

The above and other objects of the invention can be best understood upon review of the following discussion of an embodiment of the invention taken together with the drawings.

BRIEF DESCRIPTION OF THE DRAWINGS

FIG. 3 is a circuit diagram illustrating a code actuated switch mechanism for a spur line switch.

FIG. 4 is a diagrammatic representation of the manner of cooperation of a vehicle mounted code device reflector with the detector of an optoelectronic reader unit.

DESCRIPTION OF THE PREFERRED EMBODIMENTS

Figure 1:
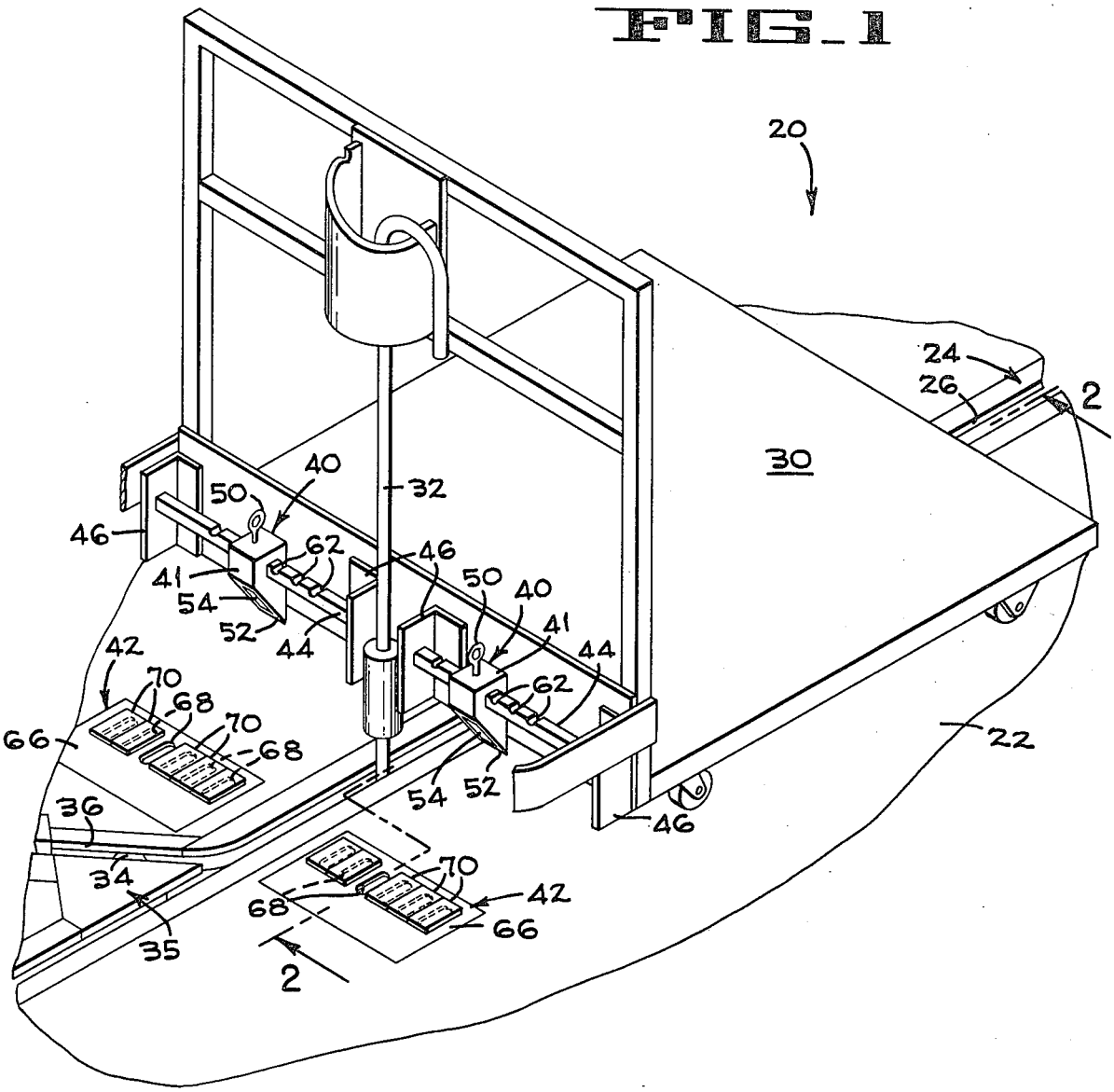
FIG. 1 is a perspective view of a truck of an in-the-floor truck tow conveyor showing one embodiment of a coding mechanism.
Figure 2:
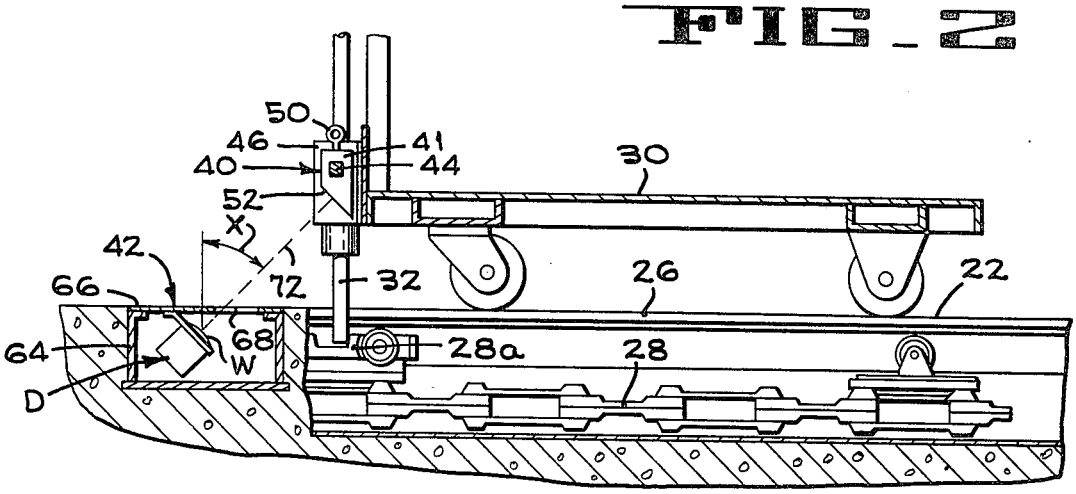
FIG. 2 is a fragmentary, schematic view, taken generally along line 2—2 of FIG. 1, showing the manner of mounting a detector of an optoelectronic reader unit under a barrier surface means in accordance with the practice of the present invention.

A small portion of a truck tow conveyor system is shown in FIG. 1 and is generally designated as 20. The system 20 is shown with a reference surface, such as the floor 22, and has a main track 24 with a tow pin slot 26 therein. A powered conveyor chain 28 in the bottom of the main track slot 26 is indicated in FIG. 2. A transport vehicle, such as a carrier, or truck, 30 has a central tow pin 32 shown in the tow pin slot 26. The chain 28 includes pusher dogs 28*a* disposed at set intervals therealong and adapted to engage the tow pin 32 mounted on the tow truck 30. When the tow truck 30 is properly loaded it is moved over slot 26 and the tow pin 32 is dropped into the slot so that the next approaching pusher dog 28*a* will engage the tow pin and propel the tow truck along the slot. The diverter, or switch, plate 34 of a typical track switch 35, and spur track 36, are also indicated in FIG. 1.

Figure 5:
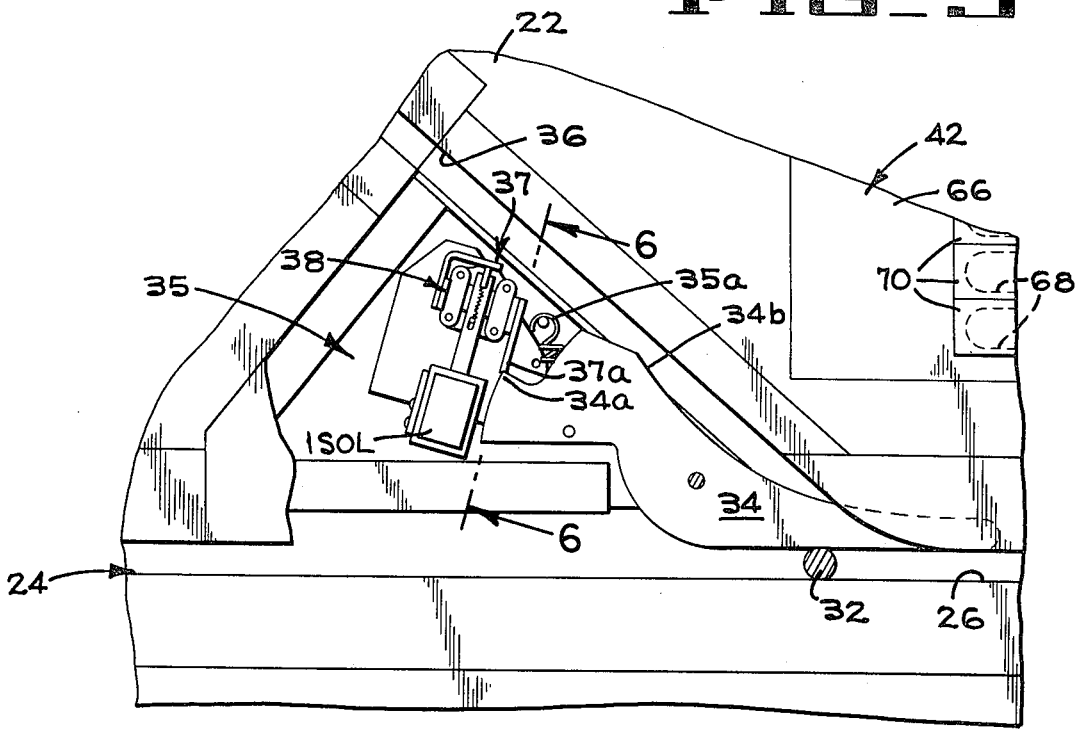
FIG. 5 is a plan view illustrating a switch actuating mechanism of a spur line switch.
Figure 6:
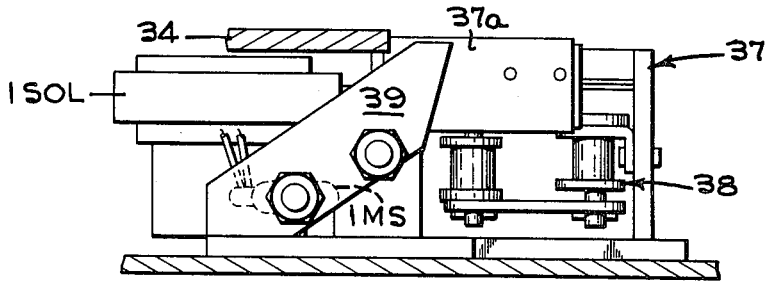
FIG. 6 is a section taken generally along line 6—6 of FIG. 5.

The switch plate 34 (see FIG. 5), which defines a control member to control upon its actuation the movement of a carrier 30, may be operated by switch actuating mechanism 37 (see FIGS. 5 and 6) similar to the switch plate operating mechanism shown in the U.S. Pat. No. 3,526,192. The mechanism includes a spring 35*a* operable to urge plate 34 to a spur line open position, a latch blade 37*a* operable to engage a corner 34*a* of plate 34 and hold the plate against the bias of spring 35*a* in a main line open position, a toggle mechanism 38 operable when actuated to shift the latch blade for release of the switch plate to its normal spur line open position, and solenoid 1SOL (see also FIG. 3) to actuate the toggle mechanism of switch actuating mechanism 37. The switch plate 34 has a cam surface 34*b* which, when the switch plate is in a spur line open position, lies in the path of the tow pin 32 entering the spur line. The tow pin 32 therefore resets the switch to line latched, main line open, position as the truck passes into the spur line. A cam plate 39 (FIG. 6) is pivotally mounted under the switch plate. The cam plate, on which a mercury switch 1MS (see FIG. 3) is mounted, is tilted clockwise from the position shown in FIG. 6 by the switch plate 34, as the switch plate moves to the spur line open position, to open the switch contacts 1MS1. The cam plate is biased (by means not shown) to return to the position shown in FIG. 6 and to close contacts 1MS1 of switch 1MS when plate 34 is returned to the main line open position.

The coding mechanism of an embodiment of the present invention, as shown in FIGS. 1 and 2, includes a manually adjustable coding device 40 mounted on the truck and an optoelectronic reader unit 42 recessed in the floor adjacent switch plate 34. The coding device 40 has a code member 41 slidably mounted on a square shaft 44 which is supported in a pair of brackets 46 attached to the front of truck 30. Two coding devices 40 with respective coding members 41 may be used as shown in FIG. 1, and both members 41 may be transversely shifted across the front of the truck 30 on either side of the central tow pin 32 to selected positions. Each member 41 also has a handle 50 for conveniently moving it laterally on the associated shaft 44. Each member 41 is a block with an inclined lower surface 52 that has a reflector 54 secured thereto. A suitable reflector for this purpose is retro-reflective tape (that is, a tape which returns a light beam to its source). Type number 7610 as manufactured by the 3M Company, St. Paul, Minn., U.S.A. Shafts 44 are provided with V-grooves 62 indentations, at spaced lateral locations corresponding to various code locations for coding device 40. The grooves 62 in shafts 44 coact with ball detent mechanisms in members 41 for frictionally holding each member 41 in a given lateral position on the shafts.

The optoelectronic reader units 42 consist of a receptacle or box 64 (see FIG. 2) recessed in the floor and having a cover 66 with slot openings 68. Caps 70 are provided to block the passage of light through openings 68 not used to define the code designation of the particular spur line at which the reader is located. A detector unit D comprising a combination energy source and reflex scanner unit is mounted within the box in a manner such that an energy beam 72 from the energy source projects upwardly, at an angle to the vertical, through an aligned slot opening 68 in cover 66 into the path of trucks 30 moving along tow pin slot 26. The energy beam is a light beam that is normally supplied by an incandescent lamp, but it may be supplied by other means such as a laser which cycles off and on at a very high rate. A suitable energy source and scanner unit is manufacture by ACCU-SORT Systems, Inc., Sellersville, Penn. 18960, U.S.A. and is known as their Model 402 Reflex Scanner. This particular type of unit may be used singly or in multiple units as desired for the number of code positions required. FIG. 1 shows two reader units 42 each containing a unit D in a reader box 64, located on both sides of the tow pin slot.

It will be understood that the detectors of the reader units are differently placed laterally with respect to the main line slot 26 to define a unique code position for the detectors at each spur line switch. Thus, as herein illustrated, when two reader units are coupled to a particular switch in the manner indicated in FIG. 3, their two detectors D, considered together, are uniquely located and no other pair of detectors, of any other reader unit, is identically placed. A truck that is to be diverted to a particular spur line carries, in the illustrated embodiment, two code members 41 that have been placed so that both of them will move into optical alignment with the detector provides beams of the particular reader unit connected to the spur line switch at that particular spur line. No other reader unit has its detectors placed so that both of the two code members will move into optical alignment with them.

One form of detector D (see FIG. 4) includes, as schematically shown in FIG. 4, a lamp L which directs the light beam 72 through an opening in a mirror M. The reflector 54 on the vehicle constitutes means to direct a beam onto the detector D. When the fixed lateral position of detector D and the selected position of a code member 41 on a track approaching a switch 35 correspond, the light beam will be reflected by the reflector 54 back (that is, retro-reflected) to the detector which senses the reflected beam. The reflected beam will strike the mirror M, which is inclined at an angle to the path of the reflected beam, and be reflected by the mirror to a phototube 1PT. The phototube 1PT is a sensor, and when energized by the reflected light beam 72 will operate a relay 1CR, as shown in FIG. 3, whose contact 1CR1 then closes in order to energize the solenoid 1SOL. Mechanism 37 is operated by solenoid 1SOL to actuate the toggle mechanism 38 which is operable to release diverter plate 34 to allow it to move to its spur line open position.

FIG. 3 is a circuit diagram representing the circuit controlling the solenoid 1SOL that in turn controls switch actuating mechanism 37. This circuit, in the illustrated embodiment, includes a power source S connected to a series circuit including relay contacts 1CR1 and 2CR1 of relays 1CR and 2CR, respectively, the mercury switch contacts 1MS1 of mercury switch 1MS, and the solenoid 1SOL. Contacts 1MS1 are normally closed so that solenoid 1SOL can be energized when the normally open relay contacts 1CR1 and 2CR1 are both closed at the same time by operation of the FIG. 3 circuit in a manner to be described.

Two identical relay circuits for relays 1CR and 2CR are shown in FIG. 3, one for each of two detectors D of two reader units 42 near a particular spur line. The circuit of relay 1CR includes batteries B1, B2 and B3, vacuum tube 1VT, resistor 1R and phototube 1PT interconnected together as indicated in FIG. 3. The circuit of relay 2CR includes batteries B1, B2 and B3, vaccum tube 2VT, resistor 2R and phototube 2PT interconnected together as indicated in FIG. 3. Two or more detectors D can be used in conjunction with two or more code elements 42 with reflectors 54 on the truck to provide a greater number of code designations for the spur lines. When both code elments 41 (see FIG. 1) of a truck are set in lateral positions corresponding to the fixed lateral positions of the detectors, the switch at that particular spur line will be operated as light beams 72 are reflected by reflectors 54 and mirrors M to phototubes 1PT and 2PT as schematically illustrated in FIG. 4.

Phototube 1PT (FIG. 3) is biased to conduct when light rays of the beam 72 fall on the tube. When the phototube becomes conductive, current flows around the phototube circuit and through resistor 1R whereupon the voltage drops across grid resistor 1R, which resistor is connected to the grid of vacuum tube 1VT, causing a variation in the plate current of the vacuum tube. Vacuum tube 1VT is part of an amplifying circuit including relay 1CR. The current variation in the amplifying circuit will be an amplified image of the phototube current. Relay 1CR in the plate circuit of vacuum tube 1VT becomes energized when the light beam 72 strikes phototube 1PT, to close the normally open contacts 1CR1 of relay 1CR. In a similar way, when a beam 72 falls on phototube 2PT the relay 2CR becomes energized to close the normally open relay contacts 2CR1. Relay 1CR and relay 2CR are both energized at the same time if the detectors in the floor and code members 41 on the truck are in corresponding lateral positions.

Since contacts 1MS1 of the mercury switch 1MS are closed when the switch plate 34 is in a main line open position, the solenoid 1SOL will be energized by the source of energy S when both relays 1CR and 2CR are energized to close the relay contacts. The energization of solenoid 1SOL actuates the aforementioned toggle mechanism 38 to release the plate 34 for movement to the spur line open position. When a truck enters the spur line, the light has left the phototubes 1PT and 2PT, opening contacts 1CR1 and 2CR1, and the track switch plate 34 is returned to the main line open position closing the mercury switch contacts 1MS1.

Each detector D, according to one form of the invention, is mounted under a cover 66 which provides a barrier surface over the detector for keeping dust, dirt, debris, loose objects and other matter from the floor area near the cover from landing on the optical windows of the detector's optical emitter (lamp L) and optical receiver (phototube 1PT or 2PT) to make the detector become inoperative for its intended purpose. In the disclosed embodiment of the invention, the optical windows are provided by a common optical window element W (see FIG. 2) through which the beam 72 passes in leaving the emitter and in returning to the receiver. The window element W is made of glass or other suitable optically transparent material. The detector D is oriented with its window W located normal to the axis of the beam 72 projected by the emitter or lamp L which axis is directed upward at an angle X to the vertical. To keep matter, such as debris, from falling onto the window element W the cover opening 68 is laterally or horizontally offset from the detector D and its window element W.

It is important to keep the optical windows of the beam emitter and beam receiver of detector D clear of matter that can gather thereon to interfere with or obstruct the optical path completed between these components when a reflector 54 becomes optically aligned with them. The conductivity of phototube 1PT, and of phototube 2PT, increases with increases in the intensity of the beam incident thereon. If debris or other material collected on the optical windows of the detectors D of reader units 42, the intensity of the beams reaching the phototubes 1PT and 2PT could be diminished by the material until the resulting photoconductivity of the phototubes (and the resulting current through relays 1CR and 2CR) become inadequate to achieve energization of the control relays, which can not operate to close the relay contacts 1CR1 and 2CR1 until the relays are energized. If either optical window of a detector becomes covered with debris (or matter) to such an extent that the light rays of a beam can't pass through the debris, no light will reach the phototube of the detector. In either case the relay contacts (1CR1, 2CR1) of the detector will remain open as a reflector 54 is carried by a truck into the path of the projected beam. This circumstance is to be avoided if the detectors are to perform their intended function. Since the sensors, namely phototubes 1PT and 2PT, of the detectors must respond to incident light beams of at least a threshold intensity before the relays 1CR and 2CR are effective to close contacts 1CR1 and 2CR1, it is clear that the barrier surface means provided by covers 68 serves an important function.

Although the best mode contemplated for carrying out the present invention has been herein shown and described, it will be apparent that modification and variation may be made without departing from what is regarded to be the subject matter of the invention.

What is claimed is:

1. In a tow truck conveyor system having a main line and a plurality of spur lines, switches to connect said spur lines to said main line, transport vehicles movable along said lines, a stationary receptacle adjacent each spur line switch, code apparatus to operate a particular switch in response to the approach of a particular vehicle provided on each transport vehicle and in each receptacle including means to transmit an energy beam between the receptacle and the vehicle when the code apparatus is set for operation of the particular switch by the particular vehicle, the improvement comprising:

means to mount the code apparatus to direct said energy beam between the receptacle and the transport vehicle along a linear path substantially inclined with respect to the vertical, a fixed cover on said receptacle, said cover being disposed vertically directly over the code apparatus in the receptacle at all times, including the interval during which said linear energy beam is transmitted between the receptacle and the vehicle, to shield said apparatus from vertically falling debris, and an open slot in said cover horizontally spaced from the position of the code apparatus in the receptacle and in the path of said inclined linear beam for the unobstructed transmission of the beam through said open slot and thereby without interception by said cover, said code apparatus in said receptacle further including means to transmit a plurality of linear beams disposed in laterally spaced relation, said cover shielding said transmitting means, and an open slot in said cover for each of said beams.

2. The apparatus of claim 1 further including a removable cap for each said open slot in said cover excepting the selected open slot for code operation of a particular switch.

3. In a tow truck conveyor system having a main line and a plurality of spur lines, switches to connect said spur lines to said main line, transport vehicles movable along said lines, a stationary receptacle adjacent each spur line switch, code apparatus to operate a particular switch in response to the approach of a particular vehicle provided on each transport vehicle and in each receptacle including means to transmit an energy beam between the receptacle and the vehicle when the code apparatus is set for operation of the particular switch by the particular vehicle, the improvement comprising:

means to mount the code apparatus to direct said energy beam between the receptacle and the transport vehicle along a linear path substantially inclined with respect to the vertical, a fixed cover on said receptacle, said cover being disposed vertically directly over the code apparatus in the receptacle at at all times, including the interval during which said linear energy beam is transmitted between the receptacle and the vehicle, to shield said apparatus from vertically falling debris, an open slot in said cover horizontally spaced from the position of the code apparatus in the receptacle and in the path of said inclined linear beam for the unobstructed transmission of the beam through said open slot and thereby without interception by said cover, a sensor in the code apparatus in the receptacle, and means operable in response to a reflected inclined beam striking said sensor to operate said switch.

4. The apparatus of claim 3 wherein said coded transport vehicle has shiftable code apparatus thereon for positioning in the path of a selected inclined beam at a particular spur line to which the transport vehicle is directed.

5. The apparatus of claim 4 wherein said shiftable code apparatus reflects an inclined beam impinging thereon back along the original path of the beam.

* * * * *